United States Patent [19]

McGrath et al.

[11] 4,380,103

[45] Apr. 19, 1983

[54] BALLOON CLIP

[76] Inventors: John E. McGrath, 456 Glen Mar Rd., Glen Burnie, Md. 21061; Earl Wilson, 2922 N. Seminary Ave., Chicago, Ill. 60657

[21] Appl. No.: 285,586

[22] Filed: Jul. 21, 1981

[51] Int. Cl.[3] ..... A63H 3/06; A44B 21/00

[52] U.S. Cl. ..... 24/255 SL; 24/30.5 P; 46/90; 251/10

[58] Field of Search ..... 251/10; 46/90; 128/205.17, 346; 24/30.5 P, 132 R, 132 WL, 248 R, 248 B, 255 SL

[56] References Cited

U.S. PATENT DOCUMENTS

| | | | |
|---|---|---|---|
| 1,201,045 | 10/1916 | Head | 251/10 |
| 3,094,807 | 6/1963 | Dorman | 46/90 |
| 3,323,208 | 6/1967 | Hurley, Jr. | 30/124 |
| 3,461,876 | 8/1969 | Miller, Jr. | 251/10 |
| 3,612,475 | 10/1971 | Dinger | 251/10 |
| 3,713,622 | 1/1973 | Dinger | 251/10 |
| 3,900,989 | 8/1975 | Weisenthal | 46/90 |
| 4,193,174 | 3/1980 | Stephens | 24/132 WL |
| 4,227,730 | 10/1980 | Alexander et al. | 128/346 |
| 4,277,863 | 7/1981 | Faneuf | 24/248 R |
| 4,279,064 | 7/1981 | Simme | 24/248 R |

FOREIGN PATENT DOCUMENTS

| | | | |
|---|---|---|---|
| 2410496 | 9/1974 | Fed. Rep. of Germany | 128/346 |
| 2732326 | 1/1979 | Fed. Rep. of Germany | 128/346 |

*Primary Examiner*—Arnold Rosenthal

*Attorney, Agent, or Firm*—Brumbaugh, Graves, Donohue & Raymond

[57] ABSTRACT

An improved clip of unitary construction for sealing an object, such as the valve of a balloon, flexible tubing and the like, is disclosed. The clip has first and second clamping arms connected by an integral hinge the interior of which defines an interior clamping area. The interior surface of the hinge has a series of fine ribs which aid in retaining the object within the clip and in creating an airtight seal. Both the first and second clamping arms have first and second C-shaped flanges at their extended ends, the flange of the second arm being larger than the flange of the first arm and having an inwardly directed lip which locks the first flange within the second flange, thus locking the clamping arms together and retaining and sealing the object within the ribbed interior clamping area.

8 Claims, 4 Drawing Figures

BALLOON CLIP

BACKGROUND OF THE INVENTION

This invention relates to a clip device for sealing objects such as balloons, flexible tubing and the like.

A clip device for sealing balloons is disclosed in U.S. Pat. No. 1,201,045 to Head. The device is cut or stamped from a single piece of material, preferably sheet metal, and comprises two clamping arms connected to a central portion forming a mouthpiece through which the balloon valve is inserted. One clamping arm has a rolled end which is applied laterally across the balloon valve, thereby pinching the valve flat and compressing it into a larger C-shaped flange provided on the other clamping arm.

Another clamping device for tubular objects is disclosed in U.S. Pat. Nos. 3,612,475 and 3,713,622, both to Dinger. Two clamping arms are connected by an integral hinge, each arm having a latching means at the end opposite the hinge. These clamps compress the tube flat across the full surface area of the inner surface of the arms.

A disadvantage of the prior clip devices is the likelihood of leaks, due to the fact that the balloon valve or tube is only compressed flat.

Accordingly, it is an object of the present invention to provide an improved clip device which ensures a more reliable seal on an object, such as a balloon, flexible tube and the like.

It is another object of the invention to provide an improved clip device which is easily reopened and is reusable.

It is a further object of the invention to provide an improved clip device which is inexpensively manufactured of a suitable plastic material, and is simple in construction and operation.

SUMMARY OF THE INVENTION

These and other objects, as will become apparent, are accomplished in accordance with the present invention by an improved clip of unitary plastic structure comprising first and second clamping arms having interior and exterior surfaces. The arms are connected by an integral hinge the interior of which defines an interior clamping area having a series of fine ribs extending across the width of the clip. The ribs aid in retaining the balloon valve or such other object in the clip, and in forming a airtight seal.

The extended end of the first clamping arm is provided with an outwardly directed first C-shaped flange which opens toward the exterior surface of said first arm. The second clamping arm has a second C-shaped flange provided at its extended end which is slightly larger than the first flange. This second flange opens toward the interior of the clip and has an inwardly directed flat edge, or lip, formed at its terminus.

To seal an object with the clip after it has been inflated, a balloon, for example, the valve should be twisted once or twice to form a tightly twisted neck which is inserted into the clip all the way into the interior clamping area of the hinge. The clip is pinched shut until the rounded back surface of the first C-shaped flange abuts the inwardly directed flat lip of the second C-shaped flange. Continued pressure causes the second flange to deflect slightly, until the lip slides over the first flange, thereby locking the first flange within the second flange.

The clip should be at least ½" wide so that at least a ½" length of the balloon valve is retained in the interior of the hinge. It has been determined that a ¼" width clip does not adequately seal the valve and prevent leaks, and that a ⅝" width performs very satisfactorily.

The clip is easily reopened and is reusable. The rounded surfaces of the clamping flanges, and the relatively long arms of the clip, permit leverage and contribute to ease of reopening without the use of special tools. To reopen, one need only use a thumb to push the second C-shaped flange up and back off of the first C-shaped flange.

The device may be manufactured either by injection molding or by extrusion. The preferred method of manufacturing is by extrusion, which is substantially less expensive and necessitates relatively uniform thickness of the clamping arms.

For a further understanding of the present invention, together with other and further objects as will become apparent, reference is made to the following detailed discussion in conjunction with the drawings, and its scope will be pointed out in the appended claims.

DETAILED DESCRIPTION OF THE DRAWINGS

Figure 1:
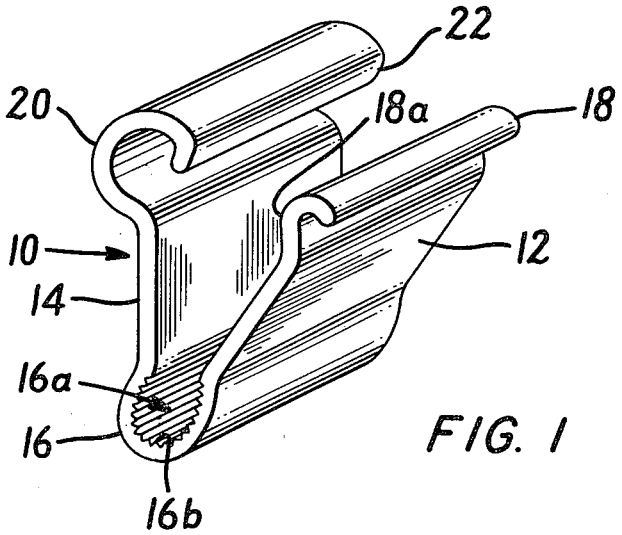
FIG. 1 is a perspective view of the clip of the present invention illustrating the clip in its unlocked configuration.

In accordance with the present invention, the clip 10 is a unitary plastic structure formed by extrusion molding, although other manufacturing techniques, for example, injection molding, are suitable.

The clip 10 has two clamping arms 12 and 14 having interior and exterior surfaces. The arms 12 and 14 are connected by an integral hinge 16. The interior of the hinge 16 defines an interior clamping area **16*a* which has a series of fine ribs 16*b* extending across the width of the clip 10**.

The extended end of the first clamping arm 12 has an outwardly directed first C-shaped flange 18 which opens toward the exterior surface of the first clamping arm 12. The second clamping arm 14 has a second C-shaped flange 20 provided at its extended end. The second flange 20 on the second clamping arm 14 is larger than the first flange 18 on the first clamping arm 12, and opens toward the interior of the clip 10. The first flange 18 is received and locked within the second flange 20 by an inwardly directed edge, or flat lip 22 formed at the terminus of the second flange 20 which extends laterally across the full width of the clip 10, as will be described more fully below.

Figure 2:
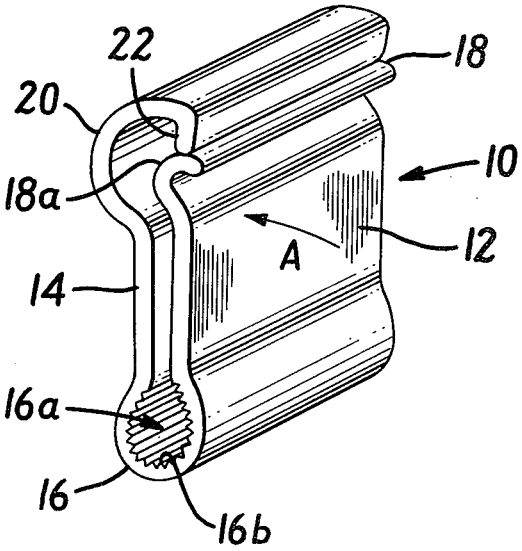
FIG. 2 is an illustration of the clip of the present invention just as the back of the first flange causes the second flange to deflect slightly.
Figure 3:
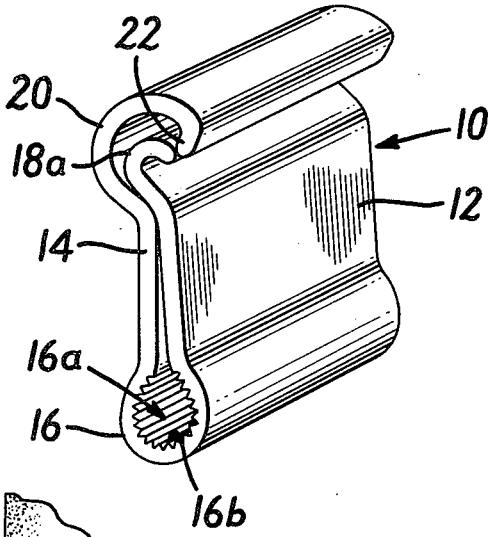
FIG. 3 is an illustration of the clip of the present invention in its locked configuration.
Figure 4:
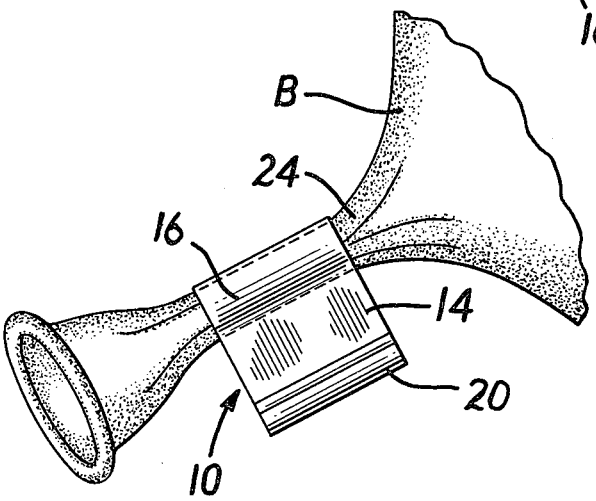
FIG. 4 is an illustration of the clip locked onto and sealing the valve of a balloon.

As seen more clearly in FIGS. 2, 3 and 4, when the clip 10 is to be used to seal the valve of a balloon B, for example, the valve of the balloon should be twisted once or twice to form a tightly twisted neck 24 which is then inserted all the way into the interior clamping area **16*a*. The clip 10 is then pinched shut, as in the direction indicated by arrow A, so that the clamping arms 12 and 14** are moved toward each other.

The rounded back surfaces 18*a* of the first flange 18 deflects the second flange 20 upon abutting the inwardly directed lip 22 on the second flange 20. Upon further application of pressure, the lip 22 of the second flange slides over the first flange 18, thereby locking the first flange 18 within the second flange 20. The ribs 16*b* of the hinge 16 aid in retaining the valve 24 of the balloon B within the interior clamping area 16*a* and provide an airtight seal.

The clip 10 is easily reopened and is reusable. The rounded surfaces of the clamping flanges 18 and 20, and the relatively long clamping arms 12 and 14, permit leverage and contribute to ease of reopening without the use of special tools. To reopen, one need only use a thumb to push the second C-shaped flange 20 up and back off of the first C-shaped flange 18.

Although the invention has been described with reference to a specific embodiment thereof, modifications and variations may be made by one skilled in the art without departing from the inventive concepts disclosed. Accordingly, all such modifications and variations are intended to be included within the spirit and scope of the appended claims.

I claim:

1. In a clip device of unitary construction for sealing an object such as the valve of a balloon, flexible tubing and the like comprising first and second arms having interior and exterior surfaces and coacting locking means on the extended ends thereof, said first and second arms being connected by an integral hinge which hinge defines an interior clamping area, the improvement wherein:

said locking means on said first arm comprises a first C-shaped flange opening toward the exterior surface of said first arm;

said locking means on said second arm comprises a second C-shaped flange being slightly larger than said first C-shaped flange and adapted to overlie and substantially conform to said first C-shaped flange when said clip device is in a closed position;

said interior clamping area of said clip having a series of fine ribs extending across the width of said clip; and said locking means further comprises means adapted to retain said locking means together in a locking relation, said retaining means being a flat lip formed at the terminus of said second C-shaped flange extending laterally across said second clamping arm and directed toward said interior clamping area;

whereby said first and second arms are urged toward each other into said closed position after the object to be sealed is inserted into said ribbed interior clamping area so that when said first C-shaped flange abuts said inwardly directed lip, said second C-shaped flange is deflected until said first C-shaped flange is within said second C-shaped flange, said inwardly directed lip thereby locking said first C-shaped flange within said second C-shaped flange and locking said first and second arms together thereby to retain said object within said ribbed interior clamping area and seal said object.

2. The clip device according to claim 1, wherein said clip device is plastic and formed by extrusion molding.

3. The clip device of claim 1 wherein said clip device is plastic and formed by injection molding.

4. The clip device of claims 1, 2 or 3, wherein the width of said clip device measured in the direction transverse to the length of said arms is about ½".

5. A clip device of unitary construction for sealing an object such as the valve of a balloon, flexible tubing and the like comprising first and second arms connected by an integral hinge which hinge defines an interior clamping area, said first and second arms having interior and exterior surfaces and coacting locking means on the extended ends thereof, said locking means on said first arm comprising a first C-shaped flange opening toward said exterior surface of said first arm, said locking means on said second arm comprising a second C-shaped flange, being slightly larger than said first C-shaped flange and adapted to overlie and substantially conform to said first C-shaped flange when said clip device is in a closed position, said second C-shaped flange further comprising a flat lip formed at the terminus of said second C-shaped flange extending laterally across said second arm and directed toward said interior clamping area, said first and second arms being urged toward each other into said closed position after the object to be sealed is inserted into said interior clamping area so that when said first C-shaped flange abuts said inwardly directed lip said second C-shaped flange is deflected until said first C-shaped flange is within said second C-shaped flange, said inwardly directed lip thereby locking said first C-shaped flange within said second C-shaped flange thereby to retain said object within said interior clamping area.

6. The clip device of claim 5, wherein said interior clamping area has a series of fine ribs extending across the width of said clip.

7. A system comprising a balloon having a valve to be sealed and a clip device for sealing said valve, said clip device being of unitary construction comprising first and second arms connected by an integral hinge which hinge defines an interior clamping area, said first and second arms having interior and exterior surfaces and coacting locking means on the extended ends thereof, said locking means on said first arm comprising a first C-shaped flange opening toward said exterior surface of said first arm, said locking means on said second arm comprising a second C-shaped flange, being slightly larger than said first C-shaped flange and adapted to overlie and substantially conform to said first C-shaped flange when said clip device is in a closed position, said second C-shaped flange further comprising a flat lip formed at the terminus of said second C-shaped flange extending laterally across said second arm and directed toward said interior clamping area, said first and second arms being urged toward each other into said closed position after the balloon valve is inserted into said interior clamping area so that when said first C-shaped flange abuts said inwardly directed lip said second C-shaped flange is deflected until said first C-shaped flange is within said second C-shaped flange, said inwardly directed lip thereby locking said first C-shaped flange within said second C-shaped flange thereby to retain said object within said interior clamping area.

8. The system of claim 7, wherein the interior clamping area of said clip device has a series of fine ribs extending across the width of said clip.

* * * * *